United States Patent [19]

Deisch

[11] Patent Number: 4,947,551

[45] Date of Patent: Aug. 14, 1990

[54] LATERALLY FOLDABLE LOCK KNIFE

[76] Inventor: David Deisch, 71200 CR 7, Nappanee, Ind. 46550

[21] Appl. No.: 372,912

[22] Filed: Jun. 28, 1989

[51] Int. Cl.[5] ..... B26B 3/00

[52] U.S. Cl. ..... 30/161; 30/331

[58] Field of Search ..... 30/155, 160, 161, 324–331, 30/340

[56] References Cited

U.S. PATENT DOCUMENTS

| | | | |
|---|---|---|---|
| 1,321,670 | 11/1919 | Popper | 30/155 X |
| 4,083,110 | 4/1978 | Goldin et al. | 30/155 |
| 4,536,959 | 8/1985 | Ross | 30/161 |

*Primary Examiner*—Douglas D. Watts

*Attorney, Agent, or Firm*—Todd A. Dawson

[57] ABSTRACT

A laterally foldable knife which includes a locking member slidably engageable with the blade to lock the blade into either its extended or retracted position. The locking member includes protrusions one of which is wedged between the blade proximal end and handle to lock the blade in its extended position. The other locking member protrusion is restrictively fitted within a blade proximal end notch to lock the blade in its closed position. A spring biases the lock member toward the knife blade proximal end.

4 Claims, 1 Drawing Sheet

LATERALLY FOLDABLE LOCK KNIFE

BACKGROUND OF THE INVENTION

This invention relates to a foldable knife and has specific relevance to a laterally foldable knife which may be locked into its opened or closed positions.

Heretofore, laterally foldable knives i.e. those folding toward the broadside of the knife do not positively lock the blade in extended and retracted positions. Examples of previous laterally folding knives are found in U.S. Pat. Nos. 4,083,110 and Des. 257,612. A problem associated with knife of this type is that during use it is possible for the knife to inadvertently fold from its extended position to its retracted position and seriously injure the fingers of the user.

SUMMARY OF THE INVENTION

This invention eliminates the problems identified above by providing a laterally foldable knife which may be locked into either its folded or extended positions. A lock member positively engages the proximal end of the knife blade to prevent the blade from inadvertently shifting out of either its extended or retracted position.

Accordingly it is an object of this invention to provide for a novel lockable knife.

Another object of this invention is to provide for a laterally foldable knife which locks into extended and retracted positions.

Another object of this invention is to provide for a novel lock mechanism for a foldable knife.

Other objects of this invention will become apparent upon a reading of the following description taken with the accompanying drawings.

BRIEF DESCRIPTION OF THE PREFERRED EMBODIMENTS

Figures 1, 2, 3, 4, 5, 6:
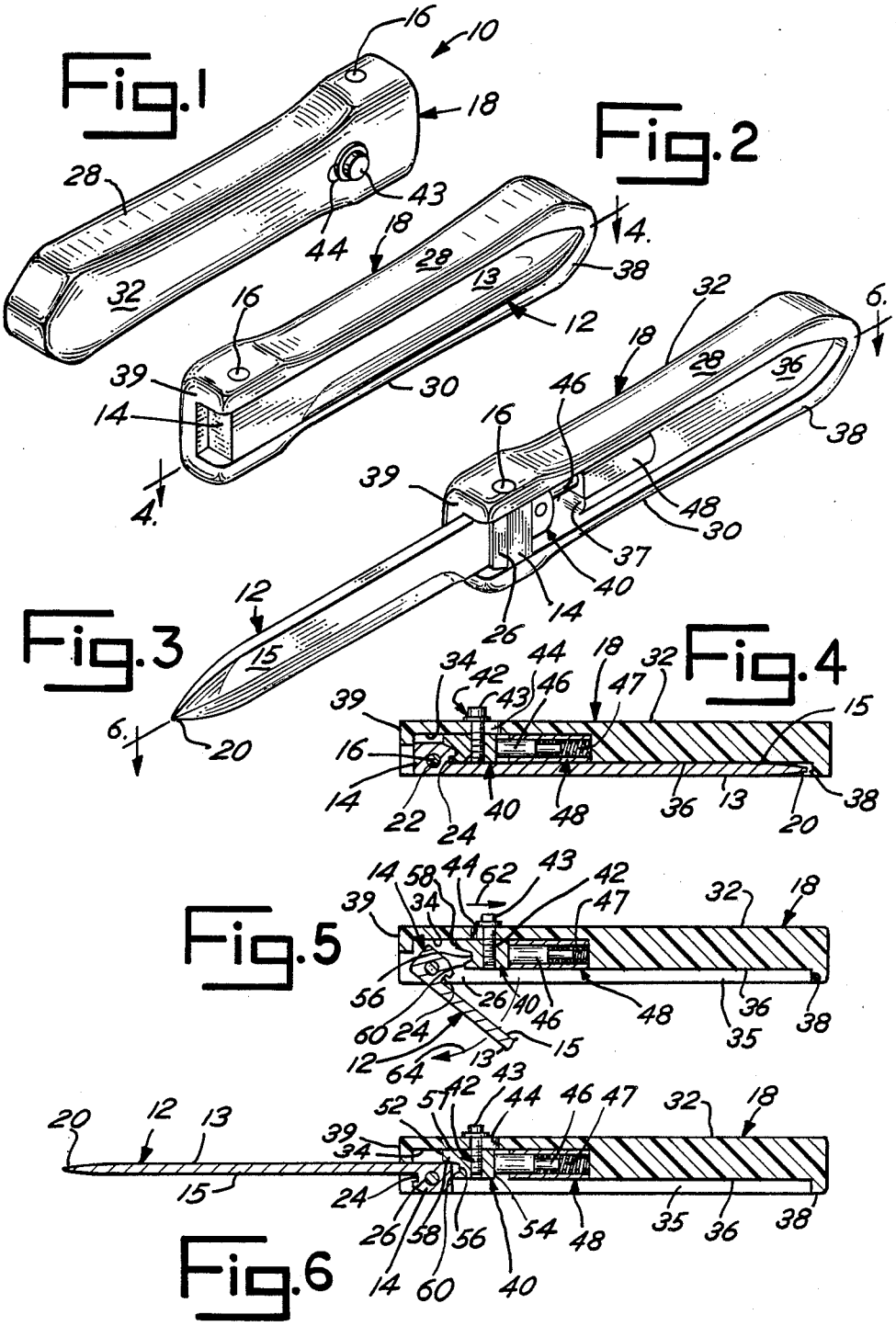
FIG. 1 is a perspective view of the knife of this invention illustrated in its closed position.
FIG. 2 is a perspective view of the knife of this invention shown in its closed positon taken from the reverse side of FIG. 1.
FIG. 3 is a perspective view of the knife of this invention illustrated in its extended position.
FIG. 4 is a sectional view taken along line 4—4 of FIG. 2.
FIG. 5 is the sectional view of FIG. 4 with the knife blade partially extended.
FIG. 6 is a sectional view taken along lines 6—6 of FIG. 3.

The preferred embodiment herein depicted is not intended to be exhaustive or to limit the application to the precise forms disclosed. Rather it is chosen and described in order to allow others skilled in the art to utilize its teachings.

Referring to the figures, knife 10 is illustrated as including a generally flat blade 12 having flat sides 13, 15 carried by a handle 18. Blade 12 has an enlarged proximal end 14 and a pointed distal end 20. Proximal end 14 of blade 12 includes a bore 22 transverse to the blades longitudinal direction as shown. Pin 16 is accommodated in bore 22 and is connected at each end to handle 18 to provide pivotal connection of blade 12 to the handle. Proximal end 14 further includes a generally U-shaped grove 24 between a bevelled outer edge 26 and blade side 15 positioned with its opening facing toward distal end 20 as illustrated.

Handle 18, as shown in FIGS. 4–6 is of a one-piece molded construction and is defined by outer surfaces 28, 30, 32, 39 and a flange 38 which defines inner surfaces 34, 36, and 37. A first cavity 33 is defined between surfaces 34, 37 and 39. A second cavity 35 is defined between surfaces 36 and flange 38. In the retracted position, blade 12 is flush with the outer surface of flange 38 as illustrated in FIGS. 2 and 4.

A lock member 40 is shiftably connected to handle 18 within cavity 34 by a threaded fastener 42 which traverses slot 44 in handle 18. Fastener 42 includes an enlarged head 43 which is extended outwardly of handle 18 to provide user access for sliding movement of the fastener in the slot. A housing 48 is frictionally retained in handle 1 and partially houses plunger 46 and its biasing spring 47. The compression force of spring 47 urges plunger 46 towards lock member 40. As illustrated in the figures, lock member 40 is defined by surfaces 52, 54 and 57. A notch 56 is defined in surface 52 and has diverging edges which form protrusions 58 and 60 as shown with protrusion 58 extending further toward knife blade proximal end 14.

In use, with the knife blade 12 in the closed position of FIGS. 2 and 4, protrusion 60 of lock member 40 is restrictively fitted within notch 24 of knife proximal end 14 to lock the knife in its closed position. To open knife 10, the user shifts fastener 42 and its attached lock member 40 in the direction of arrow 62 to urge plunger 46 rearwardly and compress spring 47. When protrusion 60 clears notch 24, knife blade 12 may be swung outwardly in the direction of arrow 64 to shift the knife blade into the extended or operative position of FIGS. 3 and 6. So positioned, the blade may be locked in its extended position by releasing fastening device 42. The compression force of spring 47 urges plunger 46 into lock member 40 to drive protrusion 54 between blade end 14 and the cavity surface 34 as illustrated. Spring 47 exerts pressure against plunger 46 and lock member 40 to maintain positive contact between distal end 14 and protrusion 58 to prevent blade 12 from inadvertently shifting out of its extended position.

To unlock blade 12, the user again shifts fastening device 42 and lock member 40 in the direction of arrow 62 until protrusion 58 clears blade proximal end 14. Knife blade 12 may then be pivoted about pin 16 into its closed and locked position of FIGS. 2 and 4. Bevelled edge 26 is provided on knife proximal end 14 adjacent notch 24 to engage protrusion 60 as the blade is being closed. Protrusion 60 contacts bevelled edge 26 thereby shifting the lock member in the direction of arrow 62 and provide positive engagement of protrusion 60 within groove 24 when protrusion 60 clears edge 26 to lock the blade 12 in the closed position shown in FIGS. 2 and 4.

It should be understood that the invention is not to be limited to the precise forms disclosed but may be modified within the scope of the appended claims.

I claim:

1. A laterally folding knife comprising a handle, a knife blade having first and second opposite flat surfaces and a proximal end, means connecting said knife blade proximal end to said handle for allowing pivotal movement of the knife blade between a retracted position wherein said blade first flat surface is positioned adjacent to said handle with said second flat surface exposed, and an extended operative position wherein said blade is longitudinally aligned with said handle, means carried by said handle for locking said blade into both of its said retracted and extended positions, wherein said blade proximal end includes a notch, said proximal end notch being spaced from said handle when said blade is in its said extended position, said locking means having a first protrusion for engaging said notch to lock said blade in its said retracted position.

2. The knife of claim 1 wherein said locking means has a second protrusion positioned between a side wall of said blade proximal end and said handle to lock said blade in its extended position.

3. The knife of claim 2 including means carried by said handle for biasing said locking means towards said blade proximal end, wherein said biasing means includes a spring retained within a cavity in said handle and a plunger in contact with said spring, said plunger contacting said locking means.

4. A laterally folding knife comprising a handle, a knife blade having first and second opposite flat surfaces and a proximal end, means connecting said knife blade proximal end and said handle for allowing pivotal movement of the knife blade between a retracted position wherein said blade first flat surface is positioned adjacent to said handle with said second flat surface exposed, and an extended operative position wherein said blade is longitudinally aligned with said handle, means carried by said handle for locking said blade into both of its said retracted and extended positions, said locking means including a body having first and second protrusions extending from said body toward said blade and defining therebetween a channel having divergent side walls, one of said protrusions being positioned between said blade proximal end and said handle when said blade is in its extended position with said proximal end contacting one of said diverging side walls to lock said blade in its extended position, the other of said protrusions engaging a notch formed in said proximal end adjacent said blade first flat surface for locking said blade in its retracted position, and means carried by said handle for biasing said locking means toward said blade proximal end.

* * * * *